US010273810B2

(12) United States Patent
Weber et al.

(10) Patent No.: US 10,273,810 B2
(45) Date of Patent: Apr. 30, 2019

(54) PARTIALLY WRAPPED TRAILING EDGE COOLING CIRCUIT WITH PRESSURE SIDE SERPENTINE CAVITIES

(71) Applicant: General Electric Company, Schenectady, NY (US)

(72) Inventors: David Wayne Weber, Simpsonville, SC (US); Brendon James Leary, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 172 days.

(21) Appl. No.: 15/334,501

(22) Filed: Oct. 26, 2016

(65) Prior Publication Data

US 2018/0112535 A1 Apr. 26, 2018

(51) Int. Cl.
*F01D 25/12* (2006.01)
*F01D 5/18* (2006.01)
*F01D 9/06* (2006.01)

(52) U.S. Cl.
CPC ..... *F01D 5/186* (2013.01); *F01D 5/188* (2013.01); *F01D 9/065* (2013.01); *F05D 2220/32* (2013.01); *F05D 2240/122* (2013.01); *F05D 2240/123* (2013.01); *F05D 2240/124* (2013.01); *F05D 2240/304* (2013.01); *F05D 2240/305* (2013.01); *F05D 2240/306* (2013.01); *F05D 2260/202* (2013.01)

(58) Field of Classification Search
CPC ..... F01D 9/065; F01D 5/147; F01D 5/186; F01D 5/187; F01D 9/041; F01D 9/06; F01D 25/08; F01D 5/18; F01D 5/188; F05D 2260/202
USPC ..... 415/115, 116; 416/95, 97 A, 97 R; 60/805
See application file for complete search history.

(56) References Cited

U.S. PATENT DOCUMENTS 2,744,723 A 5/1956 Roush
3,220,697 A 11/1965 Smuland et al.
3,844,679 A 10/1974 Grondahl et al.
3,849,025 A 11/1974 Grondahl
4,021,139 A * 5/1977 Franklin ..... F01D 5/189 415/115

(Continued)

OTHER PUBLICATIONS

U.S. Appl. No. 15/334,483, Office Action dated Jun. 28, 2018, 13 pages.

(Continued)

*Primary Examiner* — Nathaniel E Wiehe
*Assistant Examiner* — Emily S Adelman
(74) *Attorney, Agent, or Firm* — Ernest G. Cusick; Hoffman Warnick LLC

(57) ABSTRACT

A turbine blade airfoil including cooling circuits is disclosed. The airfoil may include a first pressure side cavity positioned adjacent a pressure side of the airfoil, where the first pressure side cavity is configured to receive a coolant. The airfoil may also include at least one distinct pressure side cavity positioned adjacent to and fluidly coupled to the first pressure side cavity, a trailing edge positioned between the pressure and a suction side, and a trailing edge cooling system positioned adjacent the trailing edge and in direct fluid communication with the first pressure side cavity. The trailing edge cooling system may be configured to receive a portion of the coolant from the first pressure side cavity.

15 Claims, 5 Drawing Sheets

(56) References Cited

U.S. PATENT DOCUMENTS

| | | | | |
|---|---|---|---|---|
| 4,302,153 | A | 11/1981 | Tubbs | |
| 4,684,322 | A | 8/1987 | Clifford et al. | |
| 4,761,116 | A | 8/1988 | Braddy et al. | |
| 4,940,388 | A | 7/1990 | Lilleker et al. | |
| 5,100,293 | A * | 3/1992 | Anzai | F01D 5/186 416/96 A |
| 5,464,322 | A | 11/1995 | Cunha et al. | |
| 5,536,143 | A | 7/1996 | Jacala et al. | |
| 5,915,923 | A | 6/1999 | Tomita et al. | |
| 5,967,752 | A | 10/1999 | Lee et al. | |
| 5,997,251 | A | 12/1999 | Lee | |
| 6,099,252 | A | 8/2000 | Manning et al. | |
| 6,227,804 | B1 | 5/2001 | Koga et al. | |
| 6,247,896 | B1 | 6/2001 | Auxier et al. | |
| 6,499,949 | B2 | 12/2002 | Schafrik et al. | |
| 6,547,522 | B2 | 4/2003 | Turnquist et al. | |
| 6,547,525 | B2 | 4/2003 | Haehnle et al. | |
| 7,435,053 | B2 | 10/2008 | Liang | |
| 7,530,789 | B1 * | 5/2009 | Liang | F01D 5/186 415/115 |
| 7,670,113 | B1 | 3/2010 | Liang | |
| 7,717,675 | B1 | 5/2010 | Liang | |
| 7,785,070 | B2 | 8/2010 | Liang | |
| 7,845,906 | B2 | 12/2010 | Spangler et al. | |
| 7,985,049 | B1 | 7/2011 | Liang | |
| 8,047,788 | B1 | 11/2011 | Liang | |
| 8,317,472 | B1 | 11/2012 | Liang | |
| 8,322,988 | B1 | 12/2012 | Downs et al. | |
| 8,398,370 | B1 | 3/2013 | Liang | |
| 8,562,295 | B1 * | 10/2013 | Liang | F01D 5/14 29/889.21 |
| 8,608,430 | B1 | 12/2013 | Liang | |
| 8,628,298 | B1 | 1/2014 | Liang | |
| 8,678,766 | B1 | 3/2014 | Liang | |
| 8,790,083 | B1 | 7/2014 | Liang | |
| 8,864,469 | B1 | 10/2014 | Liang | |
| 9,447,692 | B1 | 9/2016 | Liang | |
| 9,970,302 | B2 | 5/2018 | Lacy et al. | |
| 2005/0058534 | A1 | 3/2005 | Lee et al. | |
| 2009/0193657 | A1 | 8/2009 | Wilson, Jr. et al. | |
| 2010/0303625 | A1 | 12/2010 | Kuhne et al. | |
| 2013/0108471 | A1 | 5/2013 | Fujimoto | |
| 2013/0272850 | A1 | 10/2013 | Bunker | |
| 2014/0093379 | A1 * | 4/2014 | Tibbott | F01D 5/189 416/224 |
| 2014/0127013 | A1 * | 5/2014 | Spangler | F01D 5/18 416/1 |
| 2015/0041590 | A1 | 2/2015 | Kirtley et al. | |
| 2015/0044059 | A1 | 2/2015 | Wassynger et al. | |
| 2015/0096305 | A1 | 4/2015 | Morgan et al. | |
| 2015/0147164 | A1 | 5/2015 | Cui et al. | |
| 2015/0252728 | A1 | 9/2015 | Veiga | |
| 2015/0345303 | A1 | 12/2015 | Dong et al. | |
| 2016/0169003 | A1 * | 6/2016 | Wong | F01D 5/186 415/1 |
| 2016/0177741 | A1 | 6/2016 | Kirollos et al. | |
| 2017/0234154 | A1 | 8/2017 | Downs | |
| 2017/0350259 | A1 | 12/2017 | Dutta et al. | |
| 2018/0230815 | A1 | 8/2018 | Jones | |

OTHER PUBLICATIONS

U.S. Appl. No. 15/334,585, Office Action dated Jul. 31, 2018, 22 pages.
U.S. Appl. No. 15/334,517 Office Action dated Aug. 6, 2018, 24 pages.
U.S. Appl. No. 15/334,450 Office Action dated Aug. 15, 2018, 49 pages.
U.S. Appl. No. 15/334,563, Office Action dated Dec. 12, 2018, 18 pages.
U.S. Appl. No. 15/334,474, Office Action dated Dec. 31, 2018, 13 pages.
U.S. Appl. No. 15/334,450, Notice of Allowance dated Jan. 10, 2019, 12 pages.
U.S. Appl. No. 15/334,454, Notice of Allowance dated Jan. 24, 2019, 23 pages.
U.S. Appl. No. 15/334,585, Final Office Action dated Feb. 8, 2019, 20 pages.

* cited by examiner

PARTIALLY WRAPPED TRAILING EDGE COOLING CIRCUIT WITH PRESSURE SIDE SERPENTINE CAVITIES

CROSS-REFERENCE TO RELATED APPLICATION

This application is related to co-pending U.S. application Ser. Nos. 15/334,474, 15/334,454, 15/334,563, 15/334,585, 15/334,448, 15/334,517, 15/334,450, 15/334,471, and 15/334,483, all filed on Oct. 26, 2016

TECHNICAL FIELD

The disclosure relates generally to turbine systems, and more particularly, to turbine blade airfoils including various internal cavities that are fluidly coupled to one another.

BACKGROUND

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A multi-wall airfoil for a turbine blade typically contains an intricate maze of internal cooling passages. Cooling air (or other suitable coolant) provided by, for example, a compressor of a gas turbine system, may be passed through and out of the cooling passages to cool various portions of the multi-wall airfoil and/or turbine blade. Cooling circuits formed by one or more cooling passages in a multi-wall airfoil may include, for example, internal near wall cooling circuits, internal central cooling circuits, tip cooling circuits, and cooling circuits adjacent the leading and trailing edges of the multi-wall airfoil.

SUMMARY

A first embodiment may include an airfoil for a turbine blade. The airfoil includes: a first pressure side cavity positioned adjacent a pressure side, the first pressure side cavity configured to receive a coolant; at least one distinct pressure side cavity positioned adjacent to and fluidly coupled to the first pressure side cavity; a trailing edge positioned between the pressure side and a suction side; and a trailing edge cooling system positioned adjacent the trailing edge and in direct fluid communication with the first pressure side cavity, the trailing edge cooling system configured to receive a portion of the coolant from the first pressure side cavity.

Another embodiment may include a turbine blade including: a shank; a platform formed radially above the shank; and an airfoil formed radially above the platform, the airfoil including: a first pressure side cavity positioned adjacent a pressure side, the first pressure side cavity configured to receive a coolant; at least one distinct pressure side cavity positioned adjacent to and fluidly coupled to the first pressure side cavity; a trailing edge positioned between the pressure side and a suction side of the airfoil; and a trailing edge cooling system positioned adjacent the trailing edge and in direct fluid communication with the first pressure side cavity, the trailing edge cooling system configured to receive a portion of the coolant from the first pressure side cavity.

A further embodiment may include a turbine system including: a turbine component including a plurality of turbine blades, each of the plurality of turbine blades including: an airfoil including: a first pressure side cavity positioned adjacent a pressure side, the first pressure side cavity configured to receive a coolant; at least one distinct pressure side cavity positioned adjacent to and fluidly coupled to the first pressure side cavity; a trailing edge positioned between the pressure side and a suction side of the airfoil; and a trailing edge cooling system positioned adjacent the trailing edge and in direct fluid communication with the first pressure side cavity, the trailing edge cooling system configured to receive a portion of the coolant from the first pressure side cavity.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure.

Figure 1:
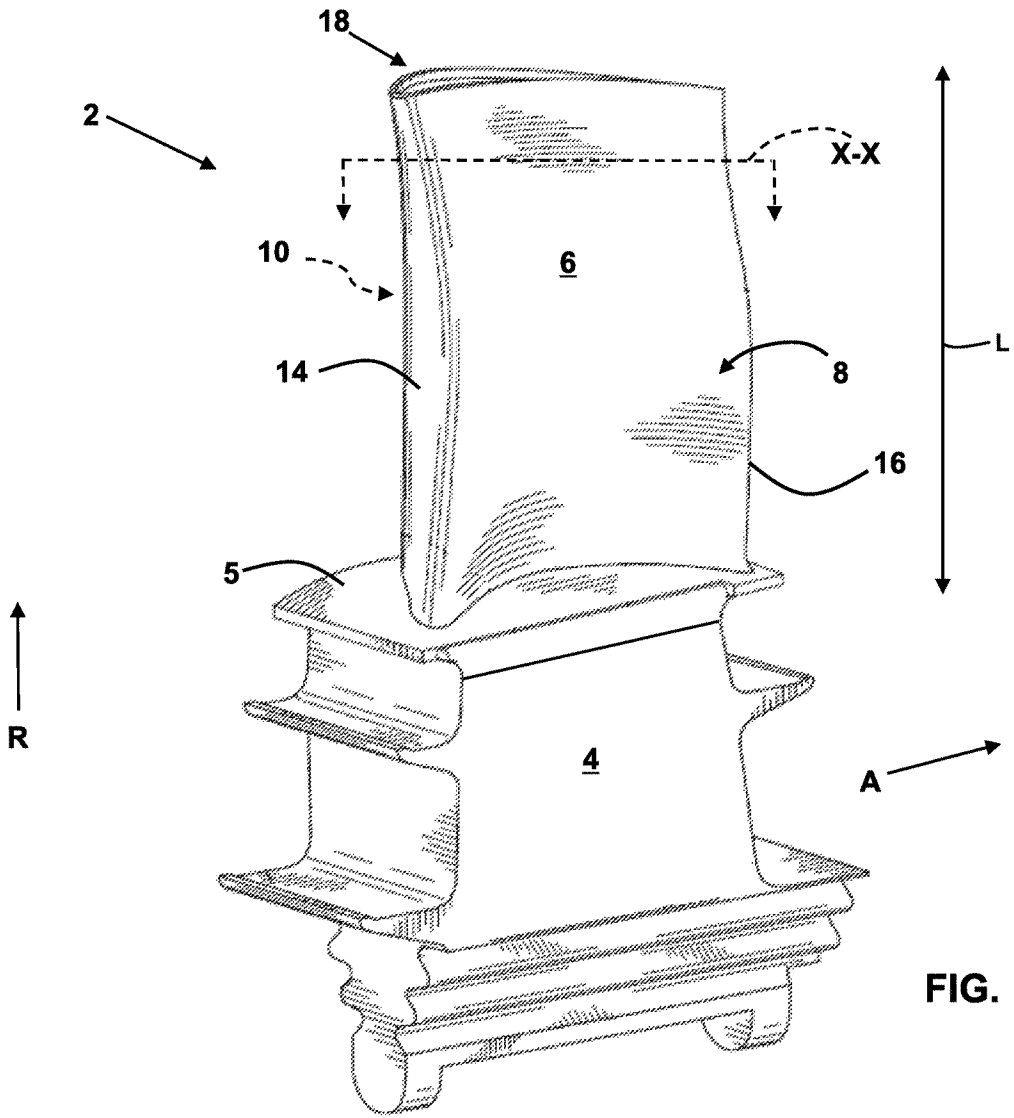
FIG. 1 depicts a perspective view of a turbine blade having a multi-wall airfoil according to various embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As indicated above, the disclosure relates generally to turbine systems, and more particularly, to turbine blade airfoils including various internal cavities that are fluidly coupled to one another. As used herein, an airfoil of a turbine blade may include, for example, a multi-wall airfoil for a rotating turbine blade or a nozzle or airfoil for a stationary vane utilized by turbine systems.

According to embodiments, a trailing edge cooling circuit with flow reuse is provided for cooling a turbine blade, and specifically a multi-wall airfoil, of a turbine system (e.g., a gas turbine system). A flow of coolant is reused after flowing through the trailing edge cooling circuit. After passing through the trailing edge cooling circuit, the flow of coolant may be collected and used to cool other sections of the airfoil and/or turbine blade. For example, the flow of coolant may be directed to at least one of the pressure or suction sides of the multi-wall airfoil of the turbine blade for convection and/or film cooling. Further, the flow of coolant may be provided to other cooling circuits within the turbine blade, including tip, and platform cooling circuits.

Traditional trailing edge cooling circuits typically eject the flow of coolant out of a turbine blade after it flows through a trailing edge cooling circuit. This is not an efficient use of the coolant, since the coolant may not have been used to its maximum heat capacity before being exhausted from the turbine blade. Contrastingly, according to embodiments, a flow of coolant, after passing through a trailing edge cooling circuit, is used for further cooling of the multi-wall airfoil and/or turbine blade.

In the Figures (see, e.g., FIG. 1), the "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "R" (see, e.g., FIG. 1), which is substantially perpendicular with axis A and intersects axis A at only one location. Finally, the term "circumferential" refers to movement or position around axis A (e.g., axis "C").

Turning to FIG. 1, a perspective view of a turbine blade 2 is shown. Turbine blade 2 includes a shank 4, a platform 5 formed radially above shank 4 and a multi-wall airfoil 6 coupled to and extending radially outward from shank 4. Multi-wall airfoil 6 may also be positioned or formed radially above platform 5, such that platform 5 is formed between shank 4 and multi-wall airfoil 6. Multi-wall airfoil 6 includes a pressure side 8, an opposed suction side 10, and a tip area 18. Multi-wall airfoil 6 further includes a leading edge 14 between pressure side 8 and suction side 10, as well as a trailing edge 16 between pressure side 8 and suction side 10 on a side opposing leading edge 14. As discussed herein, multi-wall airfoil 6 may also include a trailing edge cooling system formed therein.

Shank 4 and multi-wall airfoil 6 of turbine blade 2 may each be formed of one or more metals (e.g., nickel, alloys of nickel, etc.) and may be formed (e.g., cast, forged or otherwise machined) according to conventional approaches. Shank 4 and multi-wall airfoil 6 may be integrally formed (e.g., cast, forged, three-dimensionally printed, etc.), or may be formed as separate components which are subsequently joined (e.g., via welding, brazing, bonding or other coupling mechanism).

Figure 2:
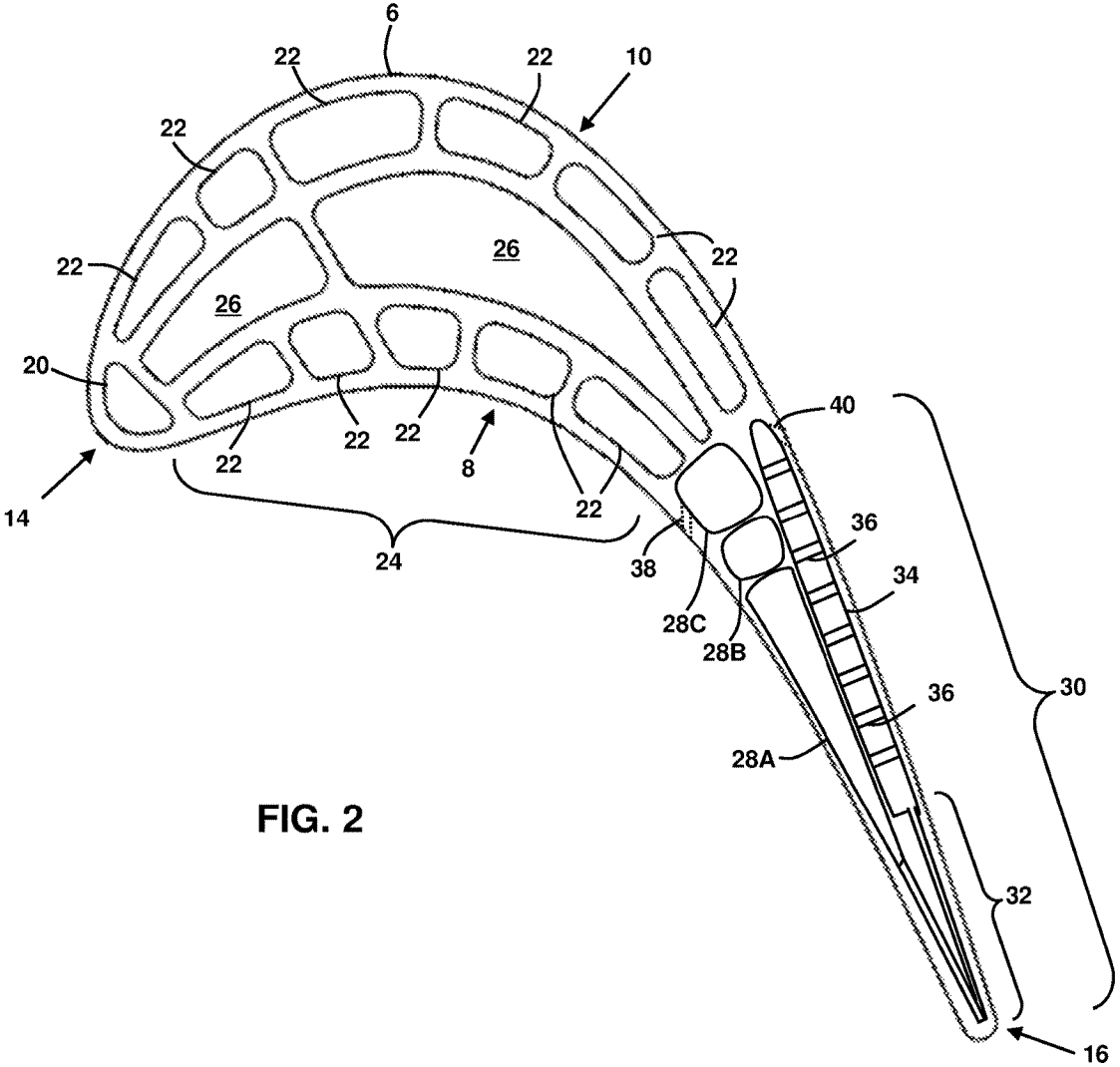
FIG. 2 depicts a cross-sectional view of the turbine blade of FIG. 1, taken along line X-X in FIG. 1 according to various embodiments.

FIG. 2 depicts a cross-sectional view of multi-wall airfoil 6 taken along line X-X of FIG. 1. As shown, multi-wall airfoil 6 may include a plurality of internal passages or cavities. In embodiments, multi-wall airfoil 6 includes at least one leading edge cavity 20, and at least one surface (near wall) cavity 22 formed in a central portion 24 of multi-wall airfoil 6. Multi-wall airfoil 6 may also include at least one internal cavity 26 formed in central portion 24 of multi-wall airfoil 6, adjacent to at least one surface cavity 22.

In a non-limiting example shown in FIG. 2, multi-wall airfoil 6 may also include a plurality of pressure side cavities 28 formed in a trailing edge portion 30 of multi-wall airfoil 6. The plurality of pressure side cavities 28 may include a first pressure side cavity 28A, a second pressure side cavity 28B and a third pressure side cavity 28C (collectively, "pressure side cavities 28"). Each of the plurality of pressure side cavities 28 may be formed and/or positioned adjacent pressure side 8 of multi-wall airfoil 6. First pressure side cavity 28A may be positioned adjacent trailing edge 16 of multi-wall airfoil 6, and/or may be positioned between second pressure side cavity 28B and trailing edge 16. Second pressure side cavity 28B may be positioned adjacent and/or between first pressure side cavity 28A and third pressure side cavity 28C. As discussed herein, the plurality of pressure side cavities 28 may be in fluid communication with one another. As shown in FIG. 2, first pressure side cavity 28A may also be positioned directly adjacent and/or may be in fluid communication with a trailing edge cooling system 32 that may also be formed and/or positioned within trailing edge portion 30 of multi-wall airfoil 6 adjacent trailing edge 16, as discussed below in detail.

Multi-wall airfoil 6 may also include at least one suction side cavity 34. In a non-limiting example shown in FIG. 2 trailing edge portion 30 of multi-wall airfoil 6 may include a suction side cavity 34 positioned and/or formed adjacent suction side 10 of multi-wall airfoil 6. Suction side cavity 34 may be positioned adjacent to, but separated from, the pressure side cavities 28 of multi-wall airfoil 6. As discussed herein, suction side cavity 34 may also be positioned directly adjacent and/or may be in fluid communication with trailing edge cooling system 32 formed and/or positioned within trailing edge portion 30 of multi-wall airfoil 6.

As shown in FIG. 2, the at least one suction side cavity 34 may include at least one obstruction 36. Obstruction(s) 36 may be formed and/or positioned throughout suction side cavity 34 of multi-wall airfoil 6. In a non-limiting example shown in FIG. 2, obstruction(s) 36 of suction side cavity 34 may be a pinbank that may modify (e.g., disrupt) flow of a coolant that may flow into suction side cavity 34 from trailing edge cooling system 32, as discussed herein. In a non-limiting example, obstruction(s) 36 of suction side cavity 34 may extend the entire radial length (L) (e.g., see, FIG. 1) of multi-wall airfoil 6. In another non-limiting example, obstruction(s) 36 of suction side cavity 34 may extend only partially radially within multi-wall airfoil 6, and may terminate radially prior to reaching the portion of airfoil 6 positioned directly adjacent platform 5 and/or tip area 18. Although obstruction(s) 36 are depicted as being substantially uniform in shape and/or size, it is understood that the shape and/or size of obstruction(s) 36 may vary based on the relative position of obstruction(s) 36 within suction side cavity 34 and/or the radial position of obstruction(s) 36 within multi-wall blade 6. Additionally, it is understood that various geometries (e.g., circular, square, rectangular and the like) may be used in forming obstruction(s) 36 within suction side cavity 34. Although discussed herein as a pinbank, it is understood that obstruction(s) 36 may include, for example, bumps, fins, plugs, and/or the like.

Although not shown, it is understood that obstruction(s) 36 may be formed in other portions of multi-wall airfoil 6. In a non-limiting example, first pressure side cavity 28A may include obstruction(s) 36 formed as a pinbank that may modify (e.g., disrupt) flow of a coolant that may flow in first pressure side cavity 28A. Specifically, obstruction(s) 36 (e.g., pinbank) may be formed in a portion of first pressure side cavity 28A adjacent to trailing edge cooling system 32. The obstruction(s) formed adjacent trailing edge cooling system 32 may modify (e.g., disrupt) the flow of a coolant that may flow from first pressure side cavity 28A to trailing edge cooling system 32, as discussed herein. Similar to obstruction(s) 36 formed in suction side cavity 34, and discussed in detail with respect to FIG. 2, obstruction(s) 36 of formed in first pressure side cavity 28A may extend the entire radial length (L) (e.g., see, FIG. 1) of multi-wall airfoil 6. Alternatively, obstruction(s) 36 of first pressure side cavity 28A may extend only partially radially within multi-wall airfoil 6, and may terminate radially prior to reaching the portion of airfoil 6 positioned directly adjacent platform 5 and/or tip area 18.

As shown in FIG. 2, turbine blade 2 (e.g., see, FIG. 1) and/or multi-wall airfoil 6 may include a plurality of film holes. Specifically, turbine blade 2 may include at least one pressure side film hole 38 (shown in phantom) formed adjacent pressure side 8 of multi-wall airfoil 6. In one non-limiting example, pressure side film hole 38 may be formed directly through a portion of pressure side 8 of multi-wall airfoil 6. In another non-limiting example, pressure side film hole 38 may be formed through a portion of platform 5 of turbine blade 2 (e.g., see, FIG. 1) adjacent pressure side 8 of multi-wall airfoil 6. In either non-limiting example, pressure side film hole 38 may be in fluid communication with and/or fluidly coupled to at least one of the plurality of pressure side cavities 28. As shown in FIG. 2, pressure side film hole 38 may be in fluid communication with and/or fluidly coupled to third pressure side cavity 28C, opposite trailing edge cooling system 32. As discussed herein, pressure side film hole 38 may be configured to exhaust, release and/or remove coolant from pressure side cavity or cavities 28, and flow the coolant over at least a portion of pressure side 8 of multi-wall airfoil 6.

As shown in FIG. 2, turbine blade 2 may also include at least one suction side film hole 40 (shown in phantom). Suction side film hole 40 may be formed adjacent suction side 10 of multi-wall airfoil 6. Similar to pressure side film hole 38, and in non-limiting examples, suction side film hole 40 may be formed directly through a portion of suction side 10 of multi-wall airfoil 6, or conversely, may be formed through a portion of platform 5 of turbine blade 2 (e.g., see, FIG. 1) adjacent suction side 10. In either non-limiting example, suction side film hole 40 may be in fluid communication with and/or fluidly coupled to pressure the at least one suction side cavity 34. As shown FIG. 2, and also similar to pressure side film hole 38, suction side film hole 40 may be in fluid communication with and/or fluidly coupled to suction side cavity 34, opposite trailing edge cooling system 32. Suction side film hole 40 may be configured to exhaust, release and/or remove coolant from suction side cavity 34, and flow the coolant over at least a portion of suction side 10 of multi-wall airfoil 6, as discussed herein.

The number of cavities formed within multi-wall airfoil 6 may vary, of course, depending upon for example, the specific configuration, size, intended use, etc., of multi-wall airfoil 6. To this extent, the number of cavities shown in the embodiments disclosed herein is not meant to be limiting.

Figure 3:
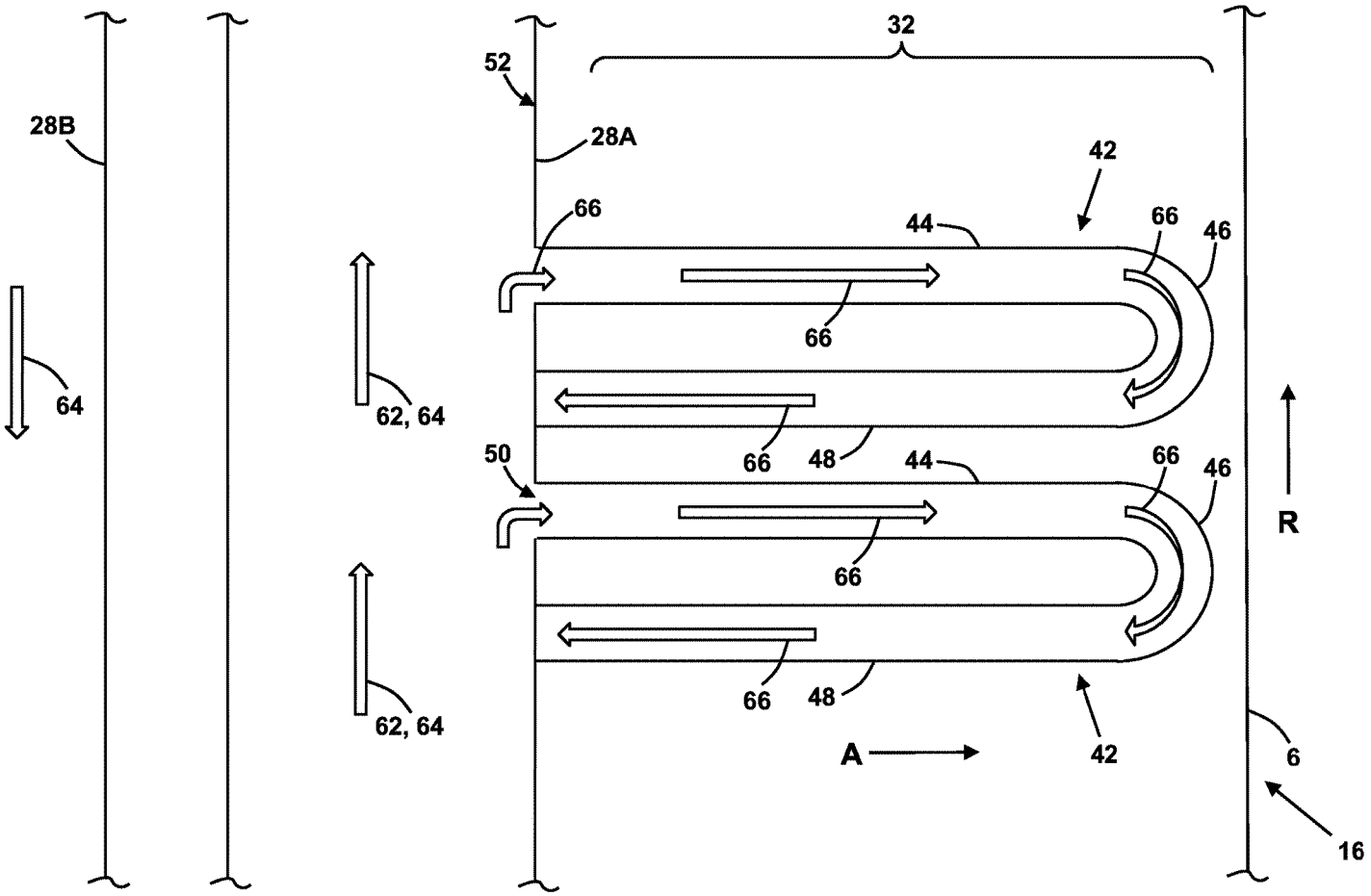
FIG. 3 depicts a side view of cooling circuits of a trailing edge cooling system and various airfoil cavities according to various embodiments.
Figure 4:
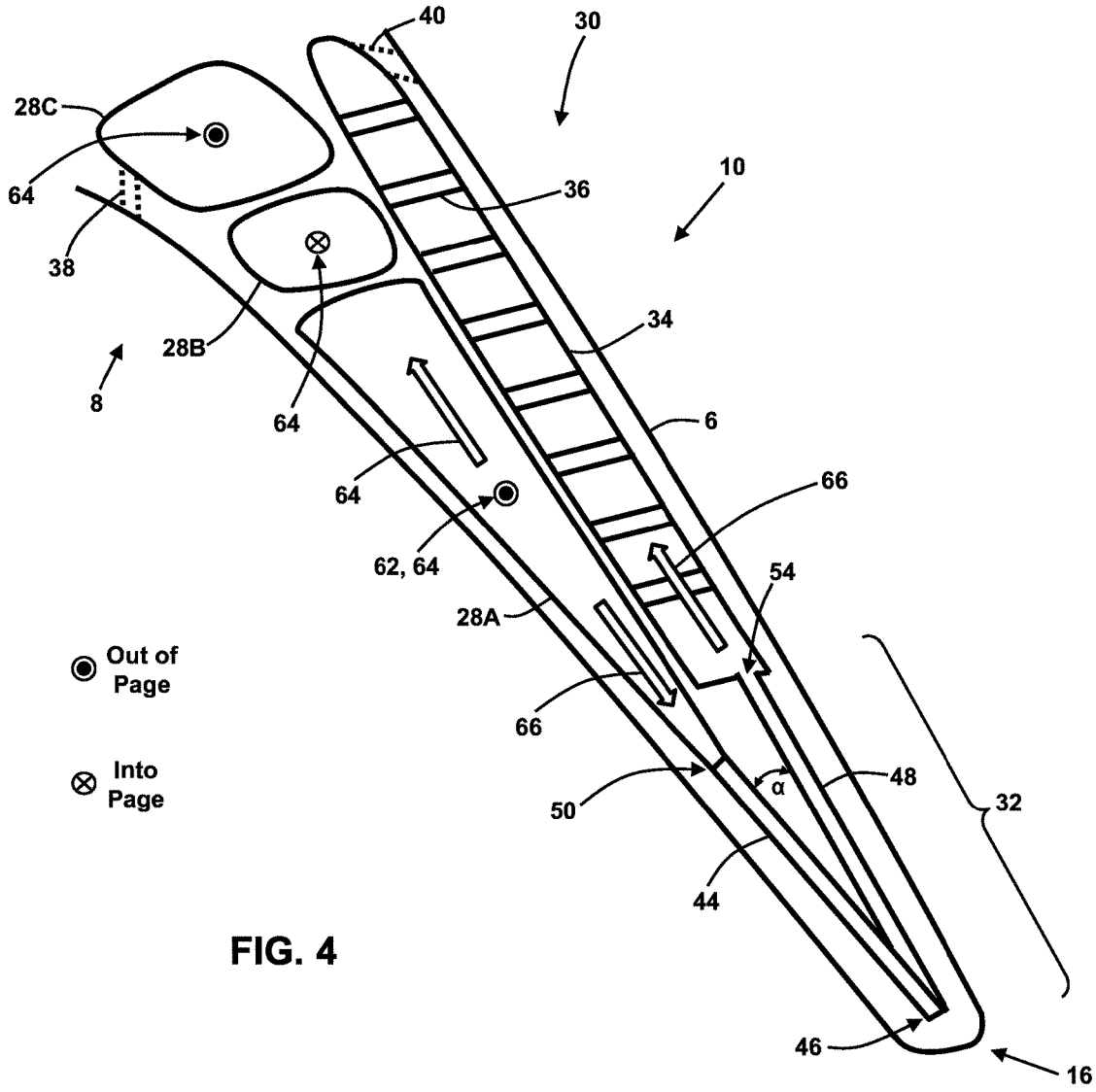
FIG. 4 depicts a top cross-sectional view of a trailing edge portion of an airfoil including various airfoil cavities and the cooling circuits of the trailing edge cooling system of FIG. 3 according to various embodiments.

An embodiment including a trailing edge cooling system 32 is depicted in FIGS. 3 and 4. As the name indicates, trailing edge cooling system 32 is located adjacent trailing edge 16 of multi-wall airfoil 6, between pressure side 8 and suction side 10 of multi-wall airfoil 6. Suction side cavity 34 is blocked from view by first pressure side cavity 28A in FIG. 3, and is therefore omitted for clarity.

Trailing edge cooling system 32 includes a plurality of radially spaced (i.e., along the "R" axis (see, e.g., FIG. 1)) cooling circuits 42 (only two are shown), each including an outward leg 44, a turn 46, and a return leg 48. Outward leg 44 extends axially toward and/or substantially perpendicular to trailing edge 16 of multi-wall airfoil 6. Return leg 48 extends axially toward leading edge 14 of multi-wall airfoil 6 e.g., see, FIG. 1). Additionally as shown in FIG. 2, return leg 48 extends axially away from and/or substantially perpendicular to trailing edge 16 of multi-wall airfoil 6. As such, outward leg 44 and return leg 48 may be, for example, positioned and/or oriented in parallel with respect to one another. Return leg 48 for each cooling circuit 42 forming trailing edge cooling system 32 may be positioned below and/or closer to shank 4 of turbine blade 2 than the corresponding outward leg 44 in fluid communication with return leg 48. In embodiments, trailing edge cooling system 32, and/or the plurality of cooling circuits 42 forming trailing edge cooling system 32, may extend along the entire radial length (L) (e.g., see, FIG. 1) of trailing edge 16 of multi-wall airfoil 6. In other embodiments, trailing edge cooling system 32 may partially extend along one or more portions of trailing edge 16 of multi-wall airfoil 6.

In each cooling circuit 42, outward leg 44 is radially offset along the "R" axis relative to return leg 48 by turn 46. To this extent, turn 46 fluidly couples outward leg 44 of cooling circuit 42 to return leg 48 of cooling circuit 42, as discussed herein. In the non-limiting embodiment shown in FIG. 2, for example, outward leg 44 is positioned radially outward relative to return leg 46 in each of cooling circuits 42. In other embodiments, in one or more of cooling circuits 42, the radial positioning of outward leg 44 relative to return leg 48 may be reversed such that outward leg 44 is positioned radially inward relative to return leg 48.

Briefly turning to FIG. 4, in addition to a radial offset, outward leg 44 may be circumferentially offset by the plurality of turn legs 46 at an angle (a) relative to return leg 48. In this configuration, outward leg 44 may extend along pressure side 8 of multi-wall airfoil 6, while return leg 48 may extend along suction side 10 of multi-wall airfoil 6. The radial and circumferential offsets may vary, for example, based on geometric and heat capacity constraints on trailing edge cooling system 32 and/or other factors.

Returning to FIG. 3, trailing edge cooling system 32 may be fluidly coupled to and/or in direct fluid communication with first pressure side cavity 28A. Specifically, cooling circuits 42 of trailing edge cooling system 32 may be in direct fluid communication with first pressure side cavity 28A. First pressure side cavity 28A may include at least one opening 50 formed through a side wall 52 to fluidly couple first pressure side cavity 28A and trailing edge cooling system 32. In a non-limiting example shown in FIG. 3, a plurality of openings 50 may be formed through side wall 52 of first pressure side cavity 28A to fluidly couple each cooling circuit 42 of trailing edge cooling system 32. That is, each of the plurality of openings 50 formed through side wall 52 of first pressure side cavity 28A may be formed axially adjacent to and/or may correspond to a distinct cooling circuit 42 of trailing edge cooling system 32, such that each opening 50 may fluidly couple the corresponding cooling circuit 42 to first pressure side cavity 28A. Additionally, outward leg 44 of each cooling circuit 42 may be in direct fluid communication with first pressure side cavity 28A via opening 50.

During operation of turbine blade 2 (e.g., see, FIG. 1), a flow of coolant 62, for example, air generated by a compressor 104 of a gas turbine system 102 (FIG. 5), flows into first pressure side cavity 28A. In the non-limiting shown in FIG. 3, coolant 62 may flow through first pressure side cavity 28A and may be divided into two distinct portions. Specifically, as coolant 62 flows through first pressure side cavity 28A, coolant 62 may be divided into a first portion 64 and a second portion 66. Each of first portion 64 and second portion 66 of coolant 62 flows through and/or to distinct portions of multi-wall airfoil 6 to provide heat transfer and/or cooling within a portion (e.g., trailing edge 16, trailing edge portion 30) of multi-wall airfoil 6. It is understood that a volume of first portion 64 and second portion 66 flowing through distinct portions of multi-wall airfoil 6 may be substantially similar, or alternatively, may be distinct from each other.

First portion 64 of coolant 62 may flow and/or be received by first pressure side cavity 28A. Specifically, first portion 64 of coolant 62 may remain within first pressure side cavity 28A of multi-wall airfoil 6 and may flow through first pressure side cavity 28A and subsequently flow through distinct portions of multi-wall airfoil 6 (e.g., second pressure side cavity 28B), as discussed herein. In the non-limiting example shown in FIG. 3, first portion 64 of coolant 62 may flow axially, radially, circumferentially or any combination thereof, through first pressure side cavity 28A of multi-wall airfoil 6. Eventually, and as discussed in detail below, all of first portion 64 of coolant 62 may flow axially away from trailing edge 16 and/or or side wall 52, toward second pressure side cavity 28B. As discussed herein, first portion 64 of coolant 62 flowing within first pressure side cavity 28A may aid in the cooling and/or heat transfer within first pressure side cavity 28A and/or other portions of multi-wall airfoil 6.

At each cooling circuit 42, second portion 66 of coolant 62 passes into outward leg 44 of cooling circuit 42 and flows axially toward turn leg 46 and/or trailing edge 16 of multi-wall airfoil 6. That is, coolant 62 may be divided within first pressure side cavity 28A and/or second portion 66 of coolant 62 may be formed by flowing through opening 50 formed through side wall 52 and subsequently into and/or axially through outward leg 44 of each cooling circuit 42. Second portion 66 of coolant 62 is redirected and/or moved as second portion 66 of coolant 62 flows through turn leg 46 of cooling circuit 42. Specifically, turn leg 46 of cooling circuit 42 redirects second portion 66 of coolant 62 to flow axially away from trailing edge 16 of multi-wall airfoil 6. Second portion 66 of coolant 62 subsequently flows into return leg 48 of cooling circuit 42 from turn leg 46, and flows axially away from trailing edge 16. In addition to flowing axially away from trailing edge 16, second portion 66 of coolant 62 flowing in return leg 48 of cooling circuit 42 may also be flowing axially toward suction side cavity 34 (see, e.g., FIG. 4). Second portion 66 of coolant 62 passing into each outward leg 44 may be the same for each cooling circuit 42 of trailing edge cooling system 32. Alternatively, second portion 66 of coolant 62 passing into each outward leg 44 may be different for different sets (i.e., one or more) of cooling circuits 42.

Turning to FIG. 4, and with continued reference to FIG. 3, trailing edge cooling system 32 may be in direct fluid communication with suction side cavity 34. Specifically, return leg 48 of cooling circuit 42 (see, e.g., FIG. 3) may be in direct fluid communication with and/or fluidly coupled to suction side cavity 34. As shown in FIG. 4, return leg 48 may extend and/or be directly coupled to suction side cavity 34 via an aperture 54 formed through suction side cavity 34. Each return leg 48 of cooling circuit 42 may be fluidly coupled to, in fluid communication with and/or coupled to a corresponding aperture 54 (one shown) formed through a wall of suction side cavity 34. As discussed herein, return leg 48 may provide second portion 66 of coolant 62 to suction side cavity 34 through aperture 54 formed in or through suction side cavity 34. It is understood that return leg 48 and suction side cavity 34 may be formed from distinct components, or alternatively, may be formed integral to one another.

The respective flow of first portion 64 and second portion 66 of coolant 62 (e.g., see, FIG. 3) through multi-wall airfoil 6 is now discussed with reference to FIGS. 3 and 4. FIG. 4 depicts a top cross-sectional view of trailing edge portion 30 of multi-wall airfoil 6 including trailing edge cooling system 32. As shown in FIG. 4, and discussed herein with respect to FIG. 3, coolant 62 and/or first portion 64 of coolant 62 may flow radially through first pressure side cavity 28A (e.g., out of the page) and may be divided into first portion 64 and second portion 66, respectively, within first pressure side cavity 28A. Additionally as discussed herein, first portion 64 of coolant 62 may flow axially through first pressure side cavity 28A and/or axially away from trailing edge 16 of multi-wall airfoil 6. Additionally, first portion 64 of coolant 62 may flow axially toward second pressure side cavity 28B.

The plurality of pressure side cavities 28 may be in fluid communication with and/or fluidly coupled to one another. As a result, first portion 64 of coolant 62 may flow between and/or through the plurality of pressure side cavities 28 of multi-wall airfoil 6. In a non-limiting example, first portion 64 of coolant 62 may flow in a serpentine pattern between the plurality of pressure side cavities 28 all fluidly coupled to one another. As discussed herein with respect to FIG. 3, and as shown in FIG. 4, first portion 64 of coolant 62 may flow radially upward (e.g., out of page) toward tip area 18 of turbine blade 2 (e.g., see, FIG. 1). From there, first portion 64 of coolant 62 may flow axially toward and into second pressure side cavity 28B. Once in second pressure side 28B, first portion 64 of coolant 62 may flow radially downward (e.g., into page) away from tip area 18, and/or radially toward platform 5 of turbine blade 2. Subsequently, first portion 64 of coolant 62 may flow axially toward and into third pressure side cavity 28C and once again flow radially upward (e.g., out of page) toward tip area 18 of turbine blade 2 once in third pressure side cavity 28C. The serpentine flow pattern of first portion 64 of coolant 62 may provide cooling and/or heat transfer to the plurality of cavities 28 and/or the surrounding surfaces and/or portions of multi-wall airfoil 6.

Additionally, after first portion 64 of coolant 62 flows to third pressure side cavity 28C, first portion 64 may flow through pressure side film hole 38 that may be fluidly coupled to third pressure side cavity 28C. Pressure side film hole 38 may exhaust and/or flow first portion 64 of coolant 62 from multi-wall airfoil 6. Specifically, first portion 64 of coolant 62 may be exhausted and/or removed from inside multi-wall airfoil 6 via pressure side film hole 38 and may flow on and/or over the outside surface or pressure side 8 of multi-wall airfoil 6. In a non-limiting example, first portion 64 of coolant 62 exhausted from multi-wall airfoil 6 via pressure side film hole 38 may flow axially toward trailing edge 16, along pressure side 8 of multi-wall airfoil 6, and may provide film cooling to the outer surface or pressure side 8 of multi-wall airfoil 6.

As shown in FIG. 4, and discussed herein with respect to FIG. 3, second portion 66 of coolant 62 may flow axially through suction side cavity 34 and/or axially away from trailing edge 16 of multi-wall airfoil 6. Second portion 66 of coolant 62 may also flow axially away from trailing edge cooling system 32, as second portion 66 flows through suction side cavity 34 and/or over obstructions 36 formed in suction side cavity 34. Second portion 66 of coolant 62 flowing (e.g., axially, radially) through suction side cavity 34 may provide cooling and/or heat transfer to suction side cavity 34 and/or the surrounding surfaces and/or portions of multi-wall airfoil 6.

Additionally, and as shown in FIG. 4, second portion 66 of coolant 62 may flow axially toward suction side film hole 40. Specifically, second portion 66 of coolant 62 may flow axially toward and subsequently through suction side film hole 40 that may be fluidly coupled to suction side cavity 34. Similar to pressure side film hole 38 and first portion 64, suction side film hole 40 may exhaust and/or flow second portion 66 of coolant 62 from multi-wall airfoil 6. Specifically, second portion 66 of coolant 62 may be exhausted and/or removed from inside multi-wall airfoil 6 via suction side film hole 40 and may flow on and/or over the outside surface or suction side 10 of multi-wall airfoil 6. In a non-limiting example, and similar to first portion 64, second portion 66 of coolant 62 exhausted from multi-wall airfoil 6 via suction side film hole 40 may flow axially toward trailing edge 16, along suction side 10 of multi-wall airfoil 6, and may provide film cooling to the outer surface or suction side 10 of multi-wall airfoil 6.

To provide additional cooling of the trailing edge of multi-wall airfoil/blade and/or to provide cooling film directly to the trailing edge, exhaust passages (not shown) may pass from any part of any of the cooling circuit(s) described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

Figure 5:
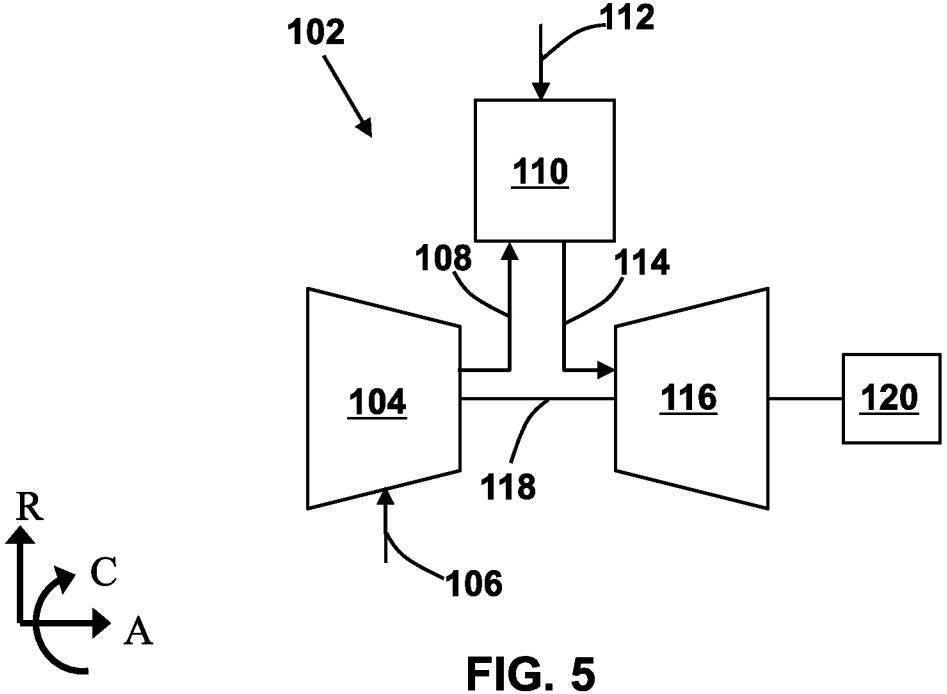
FIG. 5 depicts a schematic diagram of a gas turbine system according to various embodiments.

FIG. 5 shows a schematic view of gas turbomachine 102 as may be used herein. Gas turbomachine 102 may include a compressor 104. Compressor 104 compresses an incoming flow of air 106. Compressor 104 delivers a flow of compressed air 108 to a combustor 110. Combustor 110 mixes the flow of compressed air 108 with a pressurized flow of fuel 112 and ignites the mixture to create a flow of combustion gases 114. Although only a single combustor 110 is shown, gas turbine system 102 may include any number of combustors 110. The flow of combustion gases 114 is in turn delivered to a turbine 116, which typically includes a plurality of turbine blades 2 (FIG. 1). The flow of combustion gases 114 drives turbine 116 to produce mechanical work. The mechanical work produced in turbine 116 drives compressor 104 via a shaft 118, and may be used to drive an external load 120, such as an electrical generator and/or the like.

In various embodiments, components described as being "fluidly coupled" to or "in fluid communication" with one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An airfoil for a turbine blade, the airfoil comprising:

a first pressure side cavity positioned adjacent a pressure side, the first pressure side cavity configured to receive a coolant;

at least one distinct pressure side cavity positioned adjacent to and fluidly coupled to the first pressure side cavity;

a trailing edge positioned between the pressure side and a suction side;

at least one suction side cavity positioned adjacent the suction side; and a trailing edge cooling system positioned adjacent the trailing edge and in direct fluid communication with the first pressure side cavity, the trailing edge cooling system including:

an outward leg extending axially between the trailing edge and the first pressure side cavity, the outward leg in fluid communication with the first pressure side cavity;

a return leg extending axially between the trailing edge and the at least one suction side cavity, the return leg in fluid communication with the at least one suction side cavity; and a turn positioned directly adjacent the trailing edge, the turn fluidly coupling the outward leg and the return leg.

2. The airfoil of claim 1, wherein the trailing edge cooling system is configured to provide the received portion of the coolant to the at least one suction side cavity.

3. The airfoil of claim 2, further comprising a suction side film hole fluidly coupled to the at least one suction side cavity, the suction side film hole configured to exhaust the received portion of the coolant from the at least one suction side cavity.

4. The airfoil of claim 1, wherein the at least one suction side cavity further includes at least one obstruction.

5. The airfoil of claim 1, wherein the first pressure side cavity includes an opening formed in a side wall axially adjacent the outward leg of the trailing edge cooling system the opening fluidly coupling the outward leg to the first pressure side cavity.

6. The airfoil of claim 1, further comprising a pressure side film hole fluidly coupled to the at least one distinct pressure side cavity, the pressure side film hole configured to exhaust a distinct portion of the coolant received by the at least one distinct pressure side cavity from the first pressure side cavity.

7. A turbine blade, comprising:

a shank;

a platform formed radially above the shank; and an airfoil formed radially above the platform, the airfoil including:

a first pressure side cavity positioned adjacent a pressure side, the first pressure side cavity configured to receive a coolant;

at least one distinct pressure side cavity positioned adjacent to and fluidly coupled to the first pressure side cavity;

a trailing edge positioned between the pressure side and a suction side of the airfoil;

at least one suction side cavity positioned adjacent the suction side; and a trailing edge cooling system positioned adjacent the trailing edge and in direct fluid communication with the first pressure side cavity, the trailing edge cooling system including:

an outward leg extending axially between the trailing edge and the first pressure side cavity, the outward leg in fluid communication with the first pressure side cavity;

a return leg extending axially between the trailing edge and the at least one suction side cavity, the return leg in fluid communication with the at least one suction side cavity; and a turn positioned directly adjacent the trailing edge, the turn fluidly coupling the outward leg and the return leg.

8. The turbine blade of claim 7, wherein the trailing edge cooling system is configured to provide the received portion of the coolant to the at least one suction side cavity.

9. The turbine blade of claim 8, further comprising a suction side film hole fluidly coupled to the at least one suction side cavity, the suction side film hole configured to exhaust the received portion of the coolant from the at least one suction side cavity.

10. The turbine blade of claim 7, wherein the at least one suction side cavity of the airfoil further includes at least one obstruction.

11. The turbine blade of claim 7, wherein the first pressure side cavity of the airfoil includes an opening formed in a side wall axially adjacent the outward leg of the trailing edge cooling system, the opening fluidly coupling the outward leg to the first pressure side cavity.

12. The turbine blade of claim 7, further comprising a pressure side film hole fluidly coupled to the at least one distinct pressure side cavity of the airfoil, the pressure side film hole configured to exhaust a distinct portion of the coolant received by the at least one distinct pressure side cavity from the first pressure side cavity.

13. A turbine system comprising:

a turbine component including a plurality of turbine blades, each of the plurality of turbine blades including:

an airfoil including:

a first pressure side cavity positioned adjacent a pressure side, the first pressure side cavity configured to receive a coolant;

at least one distinct pressure side cavity positioned adjacent to and fluidly coupled to the first pressure side cavity;

a trailing edge positioned between the pressure side and a suction side of the airfoil;

at least one suction side cavity positioned adjacent the suction side; and a trailing edge cooling system positioned adjacent the trailing edge and in direct fluid communication with the first pressure side cavity, the trailing edge cooling system including a plurality of cooling circuits, each cooling circuit including:

an outward leg extending axially between the trailing edge and the first pressure side cavity, the outward leg in fluid communication with the first pressure side cavity;

a return leg extending axially between the trailing edge and the at least one suction side cavity, the return leg in fluid communication with the at least one suction side cavity; and a turn positioned directly adjacent the trailing edge, the turn fluidly coupling the outward leg and the return leg.

14. The turbine system of claim 13, wherein the first pressure side cavity of the airfoil includes a plurality of openings formed in a side wall axially adjacent the plurality of cooling circuits of the trailing edge cooling system, each of the plurality of openings fluidly coupling one of the plurality of cooling circuits to the first pressure side cavity.

15. The turbine system of claim 13, wherein each turbine blade of the plurality of turbine blades includes a pressure side film hole fluidly coupled to the at least one distinct pressure side cavity of the airfoil, the pressure side film hole configured to exhaust a distinct portion of the coolant received by the at least one distinct pressure side cavity from the first pressure side cavity.

* * * * *